US010676260B2

(12) United States Patent
Merrigan et al.

(10) Patent No.: US 10,676,260 B2
(45) Date of Patent: Jun. 9, 2020

(54) ERGONOMIC CAP FOR FILTRATION

(71) Applicant: Grayl, Inc., Seattle, WA (US)

(72) Inventors: Travis Merrigan, Seattle, WA (US); Christopher Leiter, Happy Valley, OR (US); Scott Rolfson, Portland, OR (US); Andrew Weber, Seattle, WA (US)

(73) Assignee: Grayl, Inc., Seattle, WA (US)

( * ) Notice: Subject to any disclaimer, the term of this patent is extended or adjusted under 35 U.S.C. 154(b) by 4 days.

(21) Appl. No.: 16/049,637

(22) Filed: Jul. 30, 2018

(65) Prior Publication Data

US 2019/0135506 A1 May 9, 2019

Related U.S. Application Data

(60) Provisional application No. 62/582,054, filed on Nov. 6, 2017.

(51) Int. Cl.

| | |
|---|---|
| ***B65D 47/14*** | (2006.01) |
| ***B65D 51/16*** | (2006.01) |
| ***B65D 41/04*** | (2006.01) |
| ***B65D 43/02*** | (2006.01) |
| ***B65D 47/06*** | (2006.01) |
| *B65D 23/00* | (2006.01) |

(52) U.S. Cl.

CPC ..... *B65D 51/1616* (2013.01); *B65D 41/04* (2013.01); *B65D 43/0225* (2013.01); *B65D 47/06* (2013.01); *B65D 23/00* (2013.01); *B65D 2539/001* (2013.01); *B65D 2547/06* (2013.01)

(58) Field of Classification Search

CPC ..... B65D 2251/026; B65D 2251/0087; B65D 2251/0025; B65D 2251/0078; B65D 2251/0015; B65D 41/0485; B65D 41/0471; B65D 47/142; B65D 47/143; B65D 47/122; B65D 47/147; B65D 47/148; B65D 47/128; B65D 47/127; B65D 47/125; B65D 47/126; B65D 47/123; B65D 47/12; B65D 2547/066; B65D 2547/063; B65D 2547/06; B60K 2015/0438

See application file for complete search history.

(56) References Cited

U.S. PATENT DOCUMENTS

| | | | | |
|---|---|---|---|---|
| 7,270,244 | B1 * | 9/2007 | Liu | A47J 41/0011 215/13.1 |
| 2006/0070996 | A1 * | 4/2006 | Boyle | B29C 45/1676 220/254.7 |
| 2012/0024854 | A1 * | 2/2012 | Wahl | B65D 47/248 220/262 |
| 2014/0014660 | A1 * | 1/2014 | Wu | B60K 15/0406 220/315 |

(Continued)

FOREIGN PATENT DOCUMENTS

| | | | | |
|---|---|---|---|---|
| GB | 281067 | A * | 12/1927 | B65D 41/0485 |
| WO | WO-2014070879 | A1 * | 5/2014 | |
| WO | WO-2015109197 | A1 * | 7/2015 | |

*Primary Examiner* — Allan D Stevens

(74) *Attorney, Agent, or Firm* — Rowan TELS LLC

(57) ABSTRACT

A filtration container lid configured to receive a force to filter a fluid in a filtration container assembly comprising a filtration container assembly attachment, a side wall, a top wall having a first concave surface, a cap-mounting portion having two second concave surfaces, and a cap.

18 Claims, 8 Drawing Sheets

(56) References Cited

U.S. PATENT DOCUMENTS

| | | | | |
|---|---|---|---|---|
| 2015/0314929 | A1* | 11/2015 | Tebbe | B65D 47/06<br>222/567 |
| 2018/0178946 | A1* | 6/2018 | Kekeba | B65D 11/04 |
| 2019/0100362 | A1* | 4/2019 | Meyers | B65D 47/0866 |

* cited by examiner

ERGONOMIC CAP FOR FILTRATION

CROSS-REFERENCE TO RELATED APPLICATIONS

This application claims benefit under 35 U.S.C. 119 to U.S. application Ser. No. 62/582,054 entitled "Ergonomic Cap for Filtration", filed on Nov. 6, 2017, and incorporated herein by reference in its entirety.

BACKGROUND

Fluid containers carry fluids that may be unsafe for consumption. To make the fluids safe, a filtration device is utilized. Some fluid filters are designed as part of the fluid container and utilize human power to push the fluid through the filter. Conventional fluid filter containers may utilize a body part other than the hands or utilize the hands inefficiently by being operated with small muscle groups, such as squeezing with the hand muscles or drawing suction with the mouth muscles. Utilizing these small muscle groups is awkward, tiring, and results in increased time and energy to filter the fluid. Thus, a design is needed to minimize the strain to these small muscle groups, while maximizing the force to filter the fluid.

BRIEF SUMMARY

The present fluid filter container utilizes a lid with multiple curved surfaces to "fit" the hands of a user, which allows a user to use mechanical advantage (e.g., body weight) instead of small muscles while reducing the strain placed on the hands of the user when delivering the force to filter the fluid. The cap of the lid may have multiple states of coupling that allow the cap to be sealed or unsealed to allow air to escape via a vent to further enhance filtration of the fluid.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1:
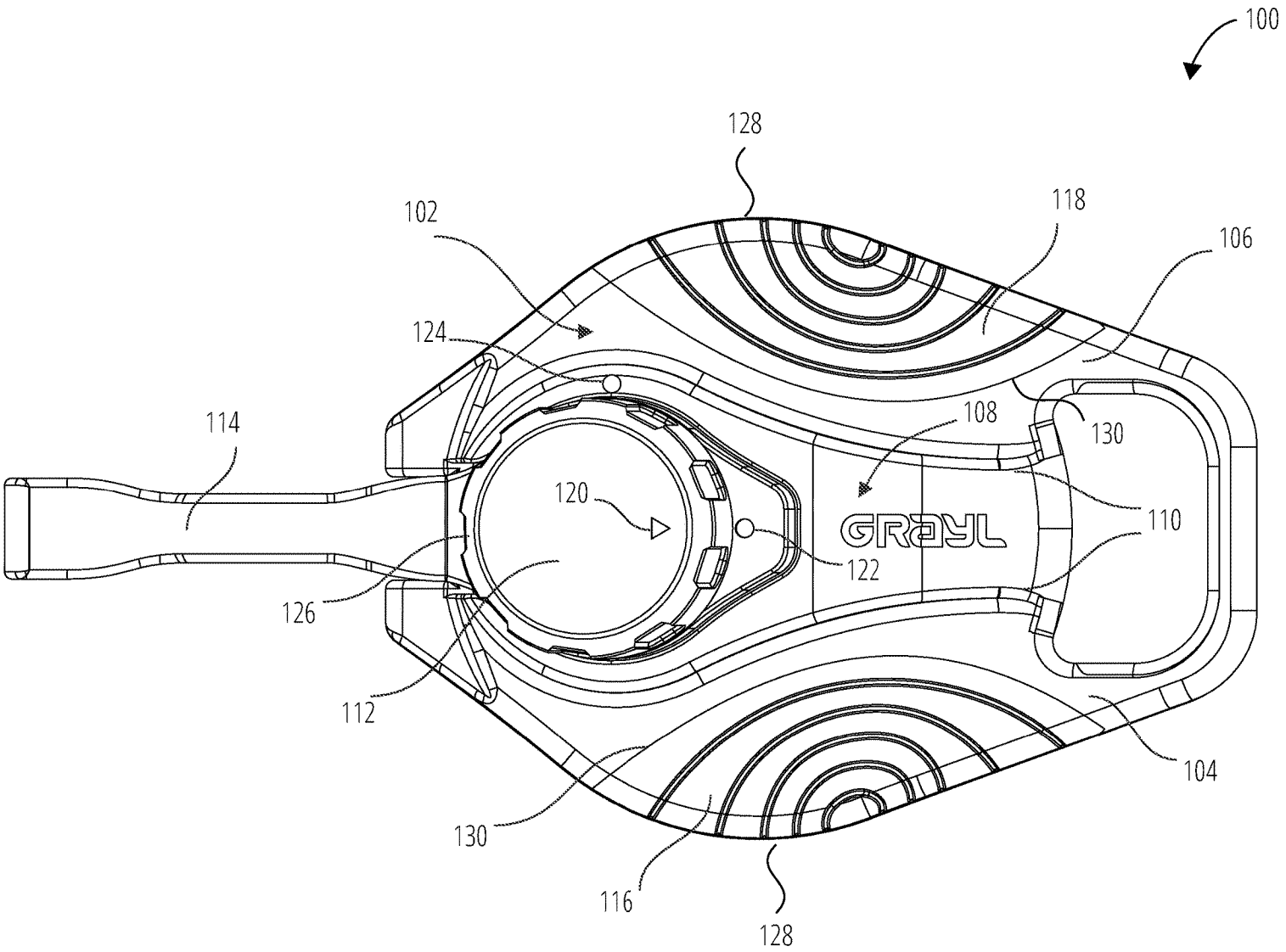
FIG. 1 illustrates an embodiment of a top view of a filtration container lid 100.

Referring to FIG. 1, the filtration container lid 100 comprises a top wall 102, a cap-mounting portion 108, a cap 112, and a leash 114. The top wall 102 has a first side 104 and a second side 106. The first side 104 and the second side 106 comprise a frictional portion 116 and a frictional portion 118, respectively. The cap-mounting portion 108 further comprises second concave surfaces 110 and a venting mechanical state indicator 124. The cap 112 further comprises a cap state indicator 120. The leash 114 further comprises the leash ring 126 and a sealed mechanical state indicator 122.

The top wall 102 is joined to a side wall (depicted in FIG. 3) and the cap-mounting portion 108. The top wall 102 is divided into the first side 104 and the second side 106 by the cap-mounting portion 108. The first side 104 and the second side 106 may be symmetric about a center line. The top wall 102 has a first concave surface and a bottom surface 314. The first concave surface (depicted in FIG. 3) is joined to the cap-mounting portion 108, and the bottom surface 314 is joined to a side wall (depicted in FIG. 3). The top wall 102 may be a rigid material. The top wall 102 may also comprise a frictional portion 116 and a frictional portion 118, each of which may comprise a different material than the other portions of the top wall 102, to enhance the ability of a contacting surface (such as the hands of a human user) to remain in contact with the top wall 102. The frictional portion 116 and the frictional portion 118 may also be more compressible than the material of the other portions of the top wall 102. This may enhance contact surface to displace the force used to operate the filtration system and enhance the frictional capabilities of the frictional portion 116 and the frictional portion 118. The frictional portion 116 and the frictional portion 118 may also comprise texture lines, which may increase the frictional capabilities of the frictional portion 116 and the frictional portion 118. The shape and the position of the frictional portion 116 and the frictional portion 118 on the top wall 102 may be altered to enhance the frictional capabilities of the frictional portion 116 and the frictional portion 118. The 2D cross-section of a portion of the frictional portion 116 and the frictional portion 118 may have two edges. The portion may be the top layer as view from above the filtration container lid 100, above being, in some embodiments by the direction opposite the extension for the side wall. The first edge 128 of the two edges of the frictional portion 116 and the frictional portion 118 may be defined by the perimeter of the top wall. The second edge 130 of the frictional portion 116 and the frictional portion 118 may be defined by a circle, an ellipse, an oval, an egg-shape, etc. The frictional portion 116 and the frictional portion 118 may be defined by different shapes. The frictional portion 116 and the frictional portion 118 may also be symmetric about an axis, such as the centerline of the top wall, such that the frictional portion 116 and the frictional portion 118 are "mirrored". In some embodiments, the frictional portion 116 and the frictional portion 118 may account for 25 to 75% of the top wall 102. The frictional portion 116 and the frictional portion 118 may comprise a thermoplastic elastomer.

Figure 6:
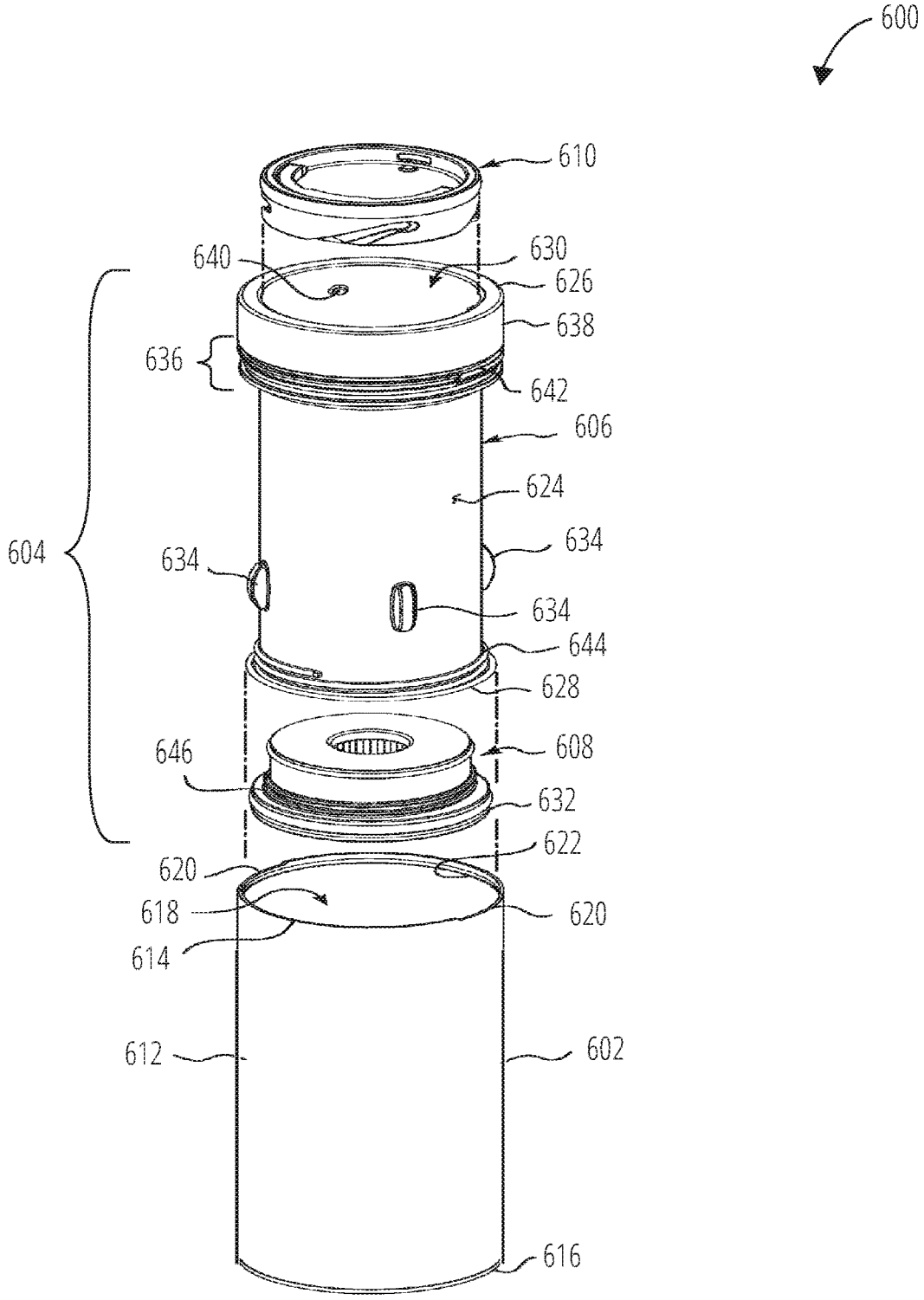
FIG. 6 illustrates an embodiment of an exploded view of a filtration container assembly 600.

The cap-mounting portion 108 is joined to the top wall 102 and is configured to be coupled to the cap 112. The cap-mounting portion 108 may be made of the same material as the top wall 102. The cap-mounting portion 108 comprises the second concave surfaces 110. The second concave surfaces 110 have a concave shape to receive an object(s) (e.g., human hands/thumbs) that contacts the filtration container lid 100 to provide the force to operate the filtration container assembly to which the filtration container lid 100 may be coupled. An exemplary filtration container assembly (i.e., filtration container assembly 600) is depicted in FIG. 6. The angle of the second concave surfaces 110 relative to the centerline between the second concave surfaces may be altered from 0 degrees to a maximum angle. The rate of change of the angle may be altered as well. The cap-mounting portion 108 may comprise an annular threaded component to couple to the cap 112. The annular threaded component engages opposing threads on the cap 112. The cap-mounting portion 108 has a venting mechanical state indicator 124. When the cap state indicator 120 is aligned with the venting mechanical state indicator 124, the cap 112 is in the venting mechanical state.

The cap 112 is coupled to the cap-mounting portion 108 and the leash 114. The cap 112 may be made of the same material as the top wall 102. The cap 112 may comprise a thermoplastic elastomer. The cap 112 may have a threaded portion that couples to the cap-mounting portion 108. The cap state indicator 120 of the cap 112 may be aligned by rotating the cap 112 (e.g., utilizing a threaded fastening with the cap-mounting portion 108) with the sealed mechanical state indicator 122 and the venting mechanical state indicator 124. When the cap state indicator 120 is aligned with the sealed mechanical state indicator 122, the cap 112 is in the sealed mechanical state. In this state, the annular threaded component of the cap-mounting portion 108 is engaged with the opposing threaded portion of the cap 112. When the cap state indicator 120 is aligned with the venting mechanical state indicator 124, the cap 112 lifts off the seal and a thread gap is formed between the annular threaded component of the cap-mounting portion 108 and the threaded portion of the cap 112. Thus, the cap 112 may operate as a vent during the filtration process while additionally precluding cross-contamination of the drinking surface located beneath the cap 112. The cap 112 may also comprise a slot or groove by which to engage the leash 114, including the leash ring 126. The depth of the groove and the diameter of the cap 112 near the groove may enable a secure fit to the leash ring 126. The cap 112 may also be disengage from the cap-mounting portion 108, exposing the spout of the cap-mounting portion 108, to enable fluid to flow through the spout.

The leash 114 is coupled to the cap 112 and a side wall (depicted in FIG. 3), such that the cap 112 is secured to the filtration container lid 100 when the cap 112 is not coupled to the cap-mounting portion 108. The leash 114 may be coupled to the side wall utilizing a pin mechanism. The leash 114 may comprise components that articulate relative to each other. The length of the leash 114 may be shortened or lengthened. A shorter length may inhibit accidental catching on objects. However, a longer length enables the cap 112 to be positioned further from the spout of the filtration container lid 100 when the cap 112 is removed from the filtration container lid 100. Additionally, a minimum amount of leash length enabled the cap 112 to be placed over the spout of the filtration container lid 100. The leash 114 may comprise a thermoplastic polyurethane. The leash 114 may have the leash ring 126 defining a circular void area that engages the cap 112. The leash ring 126 may engage a slot or groove in the cap 112. The engagement may permit the cap 112 to rotate within the leash ring 126, such as to engage or disengage threads of the cap-mounting portion 108, while other movement is inhibited. In some embodiments, the cap 112 may still be removed from the leash ring 126. The leash ring 126 may further comprise the sealed mechanical state indicator 122, which indicates a sealed mechanical state when aligned with the cap state indicator 120.

Figure 2:
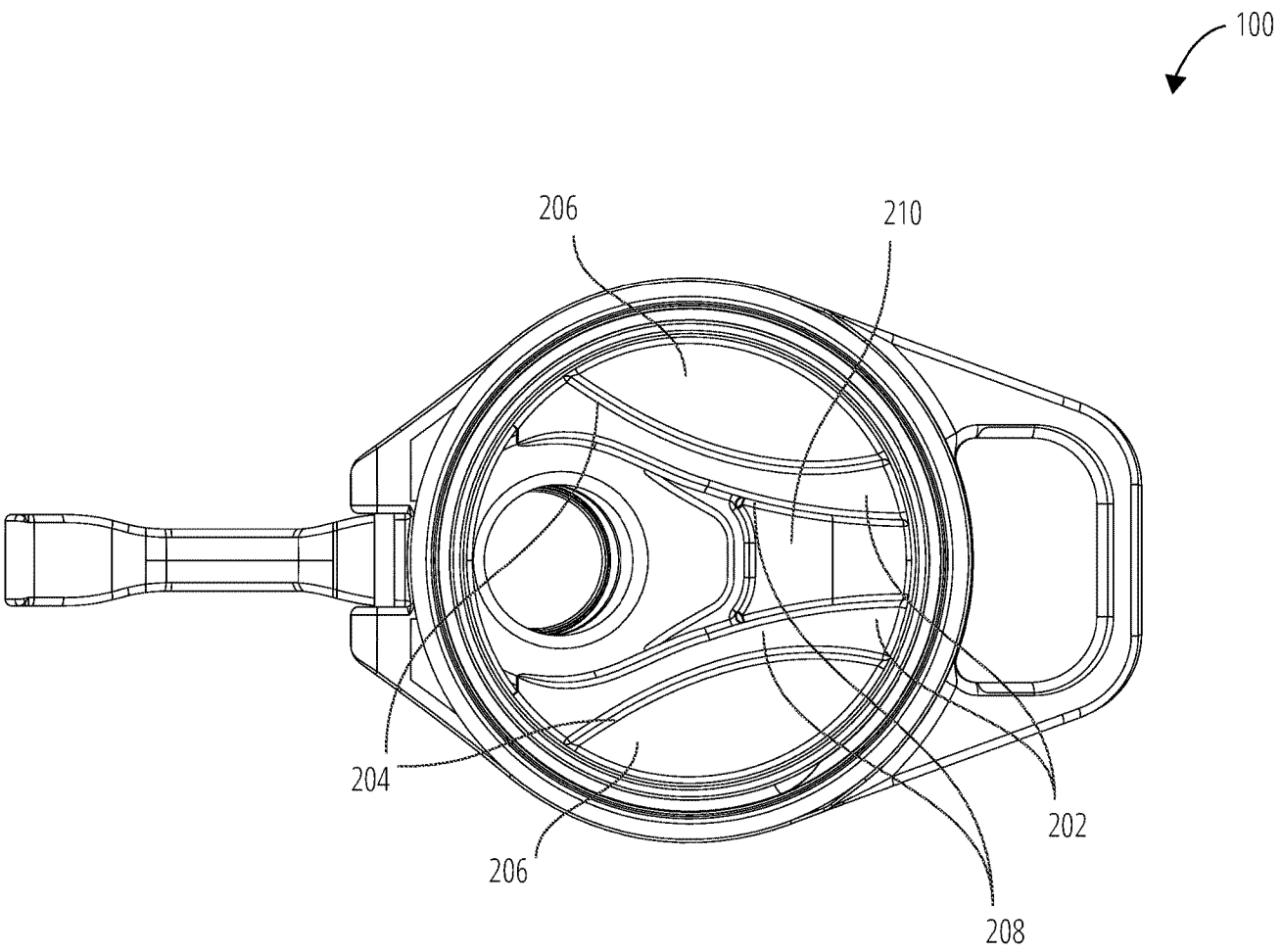
FIG. 2 illustrates an embodiment of a bottom view of a filtration container lid 100.

Referring to FIG. 2, the filtration container lid 100 comprises a top wall ridge 202, a top wall—frictional portion edge 204, a frictional portion ridge 206, a top wall — cap-mounting portion edge 208, and a cap-mounting portion ridge 210. The top wall ridge 202 is located a distance from the top wall forming a wall thickness of the top wall. The top wall—frictional portion edge 204 transitions from the top wall ridge 202 to the frictional portion ridge 206. The transition enables the frictional portion to be placed within a recess of the top wall corresponding to the frictional portion ridge 206. The top wall — cap-mounting portion edge 208 transitions from the top wall ridge 202 to the cap-mounting portion ridge 210. The cap-mounting portion ridge 210 is located a distance from the cap-mounting portion forming a wall thickness of the cap-mounting portion. The wall thickness may be the same at each ridge. In other embodiments, the wall thickness may vary. Further embodiments have one ridge through which the spout diameter extends.

Figure 3:
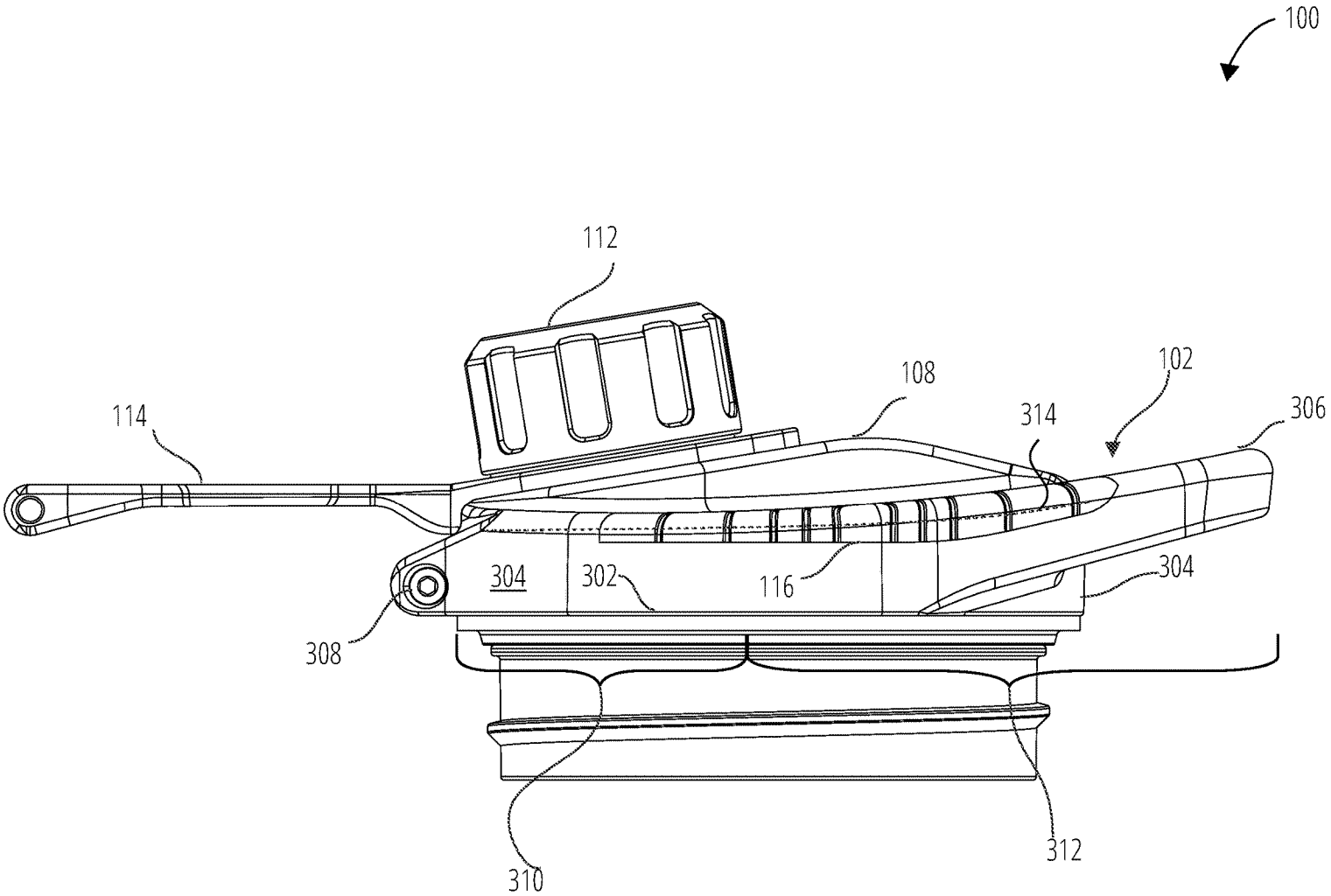
FIG. 3 illustrates an embodiment of a side view of a filtration container lid 100.

Referring to FIG. 3, the filtration container lid 100 comprises a top wall 102, a cap-mounting portion 108, a cap 112, a leash 114, a frictional portion 116, a filtration container assembly attachment 302, a side wall 304, and a first concave surface 306. The top wall 102 has an anterior portion 310 and a posterior portion 312. The side wall 304 and the first concave surface 306 has a frictional portion 116. The side wall 304 comprises a pin fastener mechanism 308.

The top wall 102, the cap-mounting portion 108, the cap 112, and the leash 114 are described in FIG. 1 above.

The filtration container assembly attachment 302 is joined to the side wall 304 and may be configured to secure to a filtration container assembly (e.g., the filtration container assembly 600). The filtration container assembly attachment 302 may be a set of one or more threads to couple to the filtration container assembly by rotating the filtration container lid 100 with respect to the filtration container assembly.

The side wall 304 is joined to the filtration container assembly attachment 302 and the top wall 102, and coupled to the leash 114. The side wall 304 may be annular-shaped having an outer surface (shown in FIG. 3) and an inner surface, the outer surface having a greater diameter than the inner surface. The side wall 304 may be joined to the top wall 102 such that the side wall 304 extends normal from the bottom surface 314 of the top wall 102. The side wall 304 may be joined to the filtration container assembly attachment 302 at the inner surface to enable coupling with the filtration container assembly (e.g., the filtration container lid 100). The side wall 304 may have an articulable coupling with the leash 114, including utilizing a pin fastener mechanism 308.

The first concave surface 306 may define a surface of the top wall 102. The first concave surface 306 may be parallel to a plane defined by the filtration container assembly attachment 302 in portions (i.e., 0 degrees with respect to the filtration container assembly attachment 302). In some embodiment, the parallel portions are located on the part of the filtration container lid 100 near the leash 114. The angle of the first concave surface 306 with respect to the filtration container assembly attachment 302 may altered to have an increase angle from the end of the filtration container lid 100 near the leash 114 to the end of the filtration container lid 100 furthest from the leash 114. The maximum slope and the rate of change of the slope may be altered to configure the top wall 102 to receive an object(s) (e.g., human hands/thumbs) that contacts the filtration container lid 100 to provide the force to operate the filtration container assembly (e.g., the filtration container assembly 600) to which the filtration container lid 100 may be coupled.

The anterior portion 310 of the top wall 102 is located at the end of the top wall 102 that the cap 112 and the leash 114 secure to the cap-mounting portion 108 and the side wall 304, respectively. The anterior portion 310 is parallel to the bottom surface 314 of the top wall 102, as well as to the filtration container assembly attachment 302 and the edge of the side wall 304 oriented away from the top wall 102.

The posterior portion 312 of the top wall 102 is located at the end of the top wall 102 that is opposite to the cap 112 and the leash 114 securing to the cap-mounting portion 108 and the side wall 304, respectively. The posterior portion 312 may form one or more first angles with the bottom surface 314 of the top wall 102, as well as to the filtration container assembly attachment 302 and the edge of the side wall 304 oriented away from the top wall 102. The one or more first angles may increase in magnitude with respect to the bottom surface 314 from the end of the posterior portion 312 adjacent to the anterior portion 310 to the end opposite from the anterior portion 310. The posterior portion 312 may extend in the posterior direction beyond where the cap-mounting portion 108 and the top wall 102 intersect. The extension may provide a greater surface area for the application of the filtering force and may extend the length of the top wall 102 to receive more of the hands of the user. In addition, the posterior portion 312 may include a void space posterior to the intersection of the cap-mounting portion 108 and the top wall 102 to form a handle that provides a mechanism to grip, carry, attach to other object (such as carabiners), etc.

Figure 4:
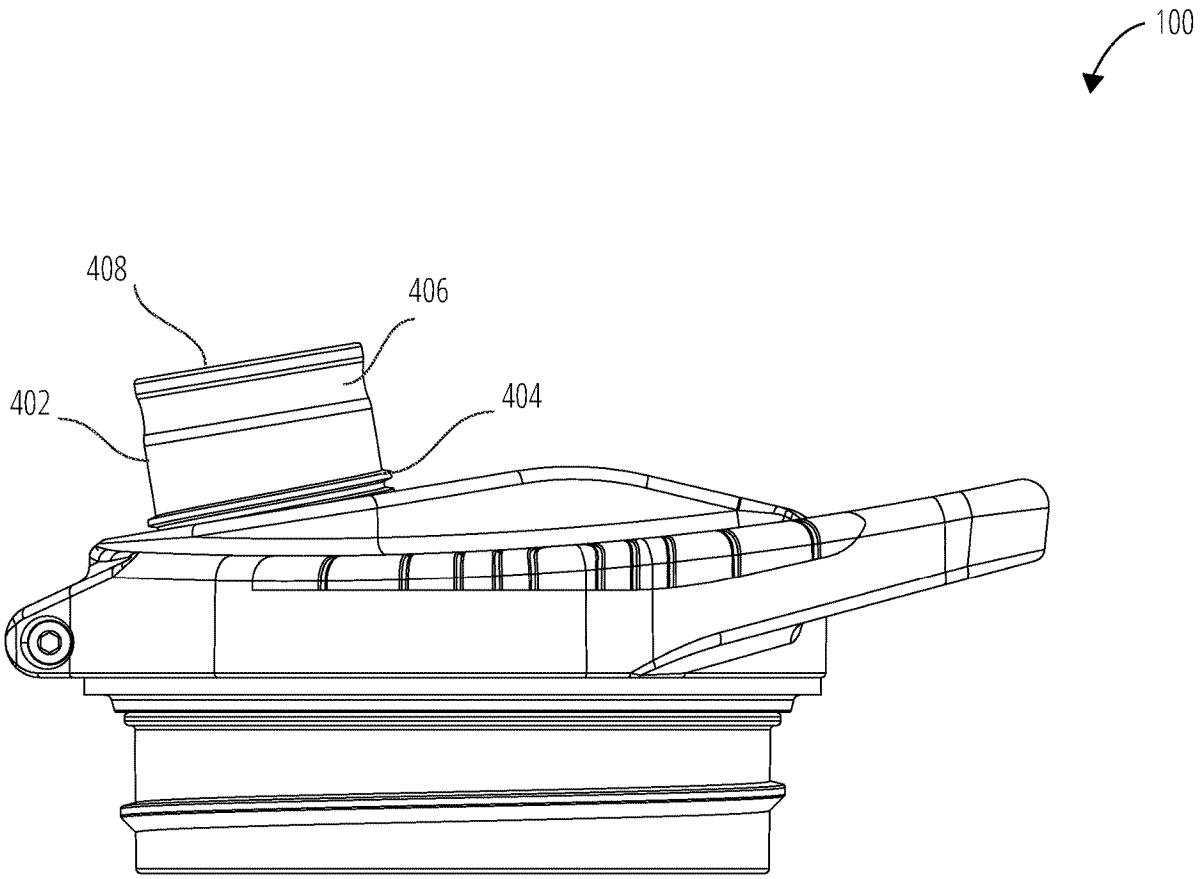
FIG. 4 illustrates an embodiment of a side view of a filtration container lid 100 without cap and leash.

Referring to FIG. 4, a filtration container lid 100 comprises a spout 402, a spout threads 404, a spout channel 406, and an edge 408. The cap 112 and the leash 114 have been removed to depict the spout 402, the spout threads 404, the spout channel 406, and the edge 408.

The spout 402 extends from the cap-mounting portion to the edge 408. The spout threads 404 engage the threaded portion of the cap 112. When the cap 112 is place in the venting mechanical state, the spout threads 404 form a thread gap with the threaded portion of the cap 112. This thread gap enables air to vent from the spout. The force to filter is reduce due to the spout channel 406. The spout channel 406 helps air to flow from the spout 402, between the cap 112 and the spout 402, and out through the disengaged threads. The spout channel 406 may have a diameter less than the diameter of the other portions of the spout 402. The spout 402 may taper to the diameter of the spout channel 406 forming a curved surface for the spout channel 406. The spout channel 406 may be located on the spout 402 between the cap-mounting portion and the edge 408. In some embodiments, the spout channel 406 is located closer to the edge 408 than to the cap-mounting portion.

Figure 5:
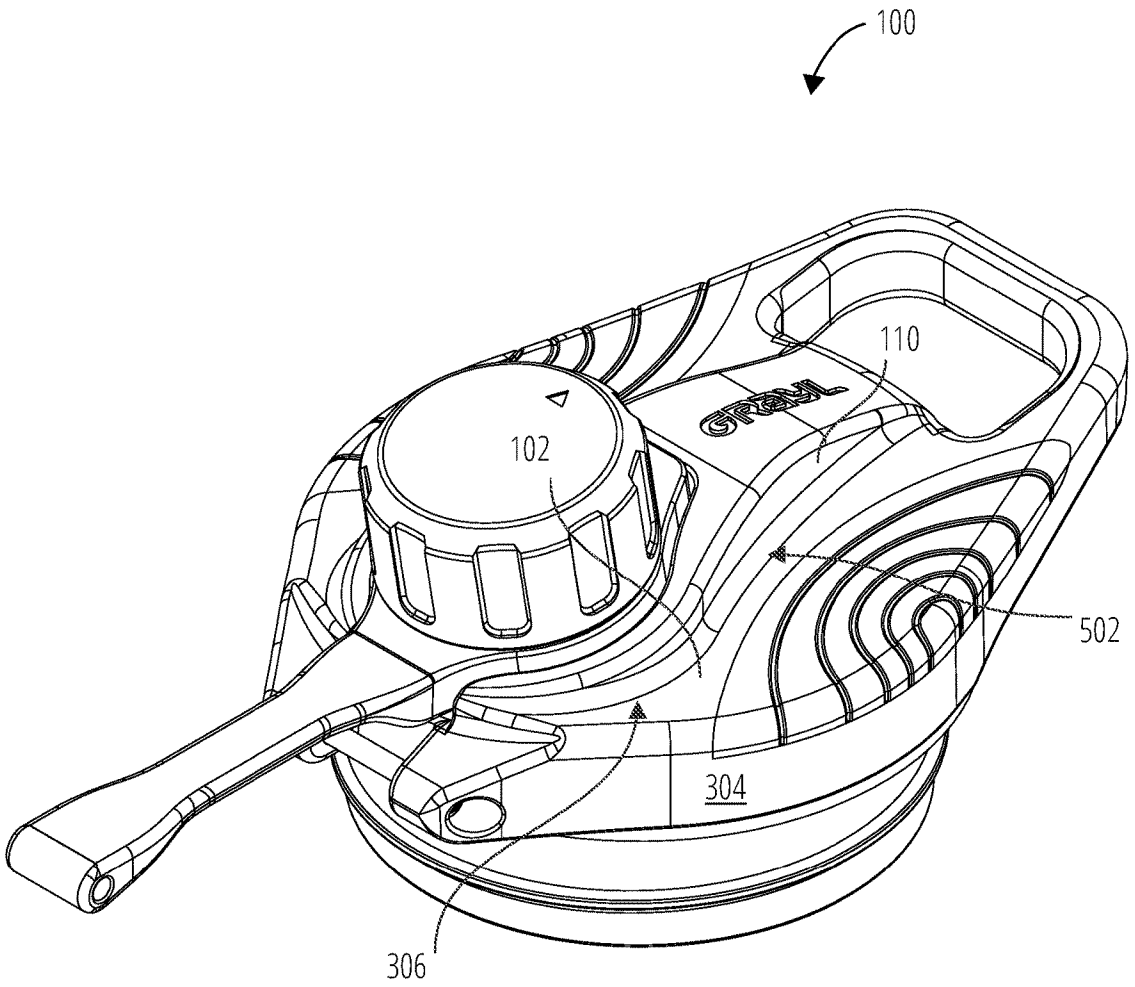
FIG. 5 illustrates an embodiment of an isometric view of a first side of a filtration container lid 100.

Referring to FIG. 5, the filtration container lid 100 comprises a first concave surface 306, a second concave surfaces 110, and a concave transition surface 502.

The second concave surfaces 110 and the first concave surface 306 are described in FIG. 1 and FIG. 3 above, respectively.

The concave transition surface 502 may join the first concave surface 306 to the second concave surfaces 110. A concave transition surface 502 may be located on both the first side and the second side of the top wall. The concave transition surface 502 may alter the angle of the slope of each of the first concave surface 306 and the second concave surfaces 110 to form a transition that flows between the two concave surfaces to create a receiving surface that is a continuously concave surface to enhance the receptability of an object(s) (e.g., human hands/thumbs) to contact the filtration container lid 100 to provide the force to operate the filtration container assembly (e.g., the filtration container assembly 600) to which the filtration container lid 100 may be coupled.

Referring to FIG. 6, the filtration container assembly 600 comprises an outer container 602, a plunging assembly 604, and a lid assembly 610. The outer container 602 may comprise a wall 612, a first open end 614, a second closed end 616, an inner cavity 618, notches 620, and an annular groove 622. The plunging assembly 604 comprises an inner sleeve 606, a filtration assembly 608, and a plunging end 632. The inner sleeve 606 may further comprise a wall 624, a first open end 626, a second open end 628, an inner bore 630, guides 634, a collar assembly 636, an annular rim 638, a plurality of extensions 640, a tab 642, and threads 644. The filtration assembly 608 may further comprise threads 646. The lid assembly 610 may be the filtration container lid described in FIG. 1, FIG. 2, FIG. 3, FIG. 4, FIG. 5, FIG. 7, FIG. 8, or another lid embodiment.

When the outer container 602 is at least partially filled with liquid, the user can exert pressure on the inner sleeve 606 to nest the plunging assembly 604 within the outer container 602, thereby using positive pressure to displace the liquid in the outer container 602 through the filtration assembly 608 into the inner sleeve 606.

Although shown and described as a personal water filtration container assembly, it should be appreciated that other embodiments are within the scope of the present disclosure. For example, an assembly within the scope of the present disclosure may be configured as a large container, such as a jug, cooler, barrel, or tank, or as a smaller container, such as a bottle or sippy cup. It should be appreciated that larger form factors may use a crank or even an electric motor to achieve the positive pressure value to perform filtration. Moreover, coffee or tea presses having an inner sleeve and outer container, but which include screen or sieve filters instead of particulate and microbial filters, are within the scope of the present disclosure. In accordance with embodiments of the present disclosure, suitable filters for use in the container assembly, include, but are not limited to screens, sieve fillers, granular-activated carbon filters, metallic alloy filters, microporous ceramic filters, a carbon block resin filters, electrostatic nanofiber filters, reverse osmosis filters, ion exchange filters, UV light filters, hollow fiber membrane filters, and ultra-filtration membrane filters. Any directional references in the present application, such as "up", "down", "top", "bottom", etc., are intended to describe the embodiments of the present disclosure with reference to the orientations provided in the figures and are not intended to be limiting.

The outer container 602 is a substantially cylindrical cup having a wall 612 extending between a first open end 614 and a second closed end 616 and defining an inner cavity 618. The term "substantially" is used herein to include standard engineering and/or manufacturing tolerances. Although shown in the illustrated embodiment as having a substantially cylindrical wall 612 on both inner and outer surfaces, it should be appreciated that other cross-sectional shapes are also within the scope of the present disclosure. For example, the outer container 602 may have a substantially cylindrical inner cavity 618, but a non-cylindrical outer surface. As described in greater detail below, a substantially cylindrical inner cavity 618 is designed and configured to mate with one embodiment of the filtration assembly 608 described herein.

At the first open end 614, the outer container 602 includes optional notches 620 along the top perimeter of the outer wall 612. Near the first open end 614, the outer container 602 further includes an internal annular groove 622 on the inner surface of the wall 612. It should be appreciated that the annular groove 622 may also be positioned on the outer surface of the wall 612. Both the notches 620 and the annular groove 622 are designed and configured for assisting in the interface between the outer container 602 and the plunging assembly 604, as described in greater detail below.

The outer container 602 is configured to receive liquid, for example, unpurified or unfiltered tap or water from a natural, untreated source. In that regard, when in use, the outer container 602 may be filled or at least partially filled with liquid.

The plunging assembly 604 will now be described. As mentioned above, the plunging assembly 604 includes the inner sleeve 606 and the filtration assembly 608, both of which are designed to be received within the inner cavity 618 of the outer container 602. In the illustrated embodiment, the inner sleeve 606 has a wall 624 extending between a first open end 626 and a second open end 628 and defining an inner bore 630. Therefore, the inner sleeve 606 has a continuous sidewall to prevent the migration of contaminants into the filtered liquid that is stored in the inner sleeve 606.

The inner sleeve 606 is configured to move like a piston relative to outer container 602, and therefore, is designed to be received within the outer container 602. Although not required, the inner sleeve 606 may have a substantially consistent cross-sectional area and/or shape along the length of inner sleeve 606. Although shown as a substantially cylindrical outer container 602, it should be appreciated that the outer container 602 may be configured to have any cross-sectional shape, so long as the inner cavity 618 of the outer container 602 and the outer wall 624 of the inner sleeve 606 are capable of nesting together. In one embodiment of the present disclosure, the inner sleeve 606 when nested is wholly contained within the inner cavity 618 of the outer container 602. In the illustrated embodiment, the inner cavity 618 of the outer container 602 is substantially cylindrical, and the plunging end 632 of the plunging assembly 604 is configured to form a seal with inner cavity 618 through the piston movement of the plunging assembly 604.

The inner sleeve 606 includes various features for interfacing with other parts of the filtration container assembly 600. For example, optional guides 634 positioned on the outer surface of wall 624 of the inner sleeve 606 allow for a guided, but spaced fit between the inner sleeve 606 and the outer container 602. Alternatively, a spacer, for example, made of plastic silicon, or rubber, which may be a seal, gasket, roller, or any other suitable spacer, may be used in place of guides 634. A plurality of depressions on the outer surface of wall 624 near the first open end 626 of the inner sleeve 606 allow for a secure fit between the body of the inner sleeve 606 and the collar assembly 636, as described in greater detail below. Moreover, on the inner surface of the inner bore 630, the inner sleeve 606 includes a plurality of extensions 640 for interfacing with the lid assembly 610.

At the first open end 626, the inner sleeve 606 is designed and configured to interface with the first open end 614 of the outer container. In that regard, the inner sleeve 606 may include an annular rim 638 and a collar assembly 636 for interfacing with the first open end 614 of the outer container 602. When the inner sleeve 606 and the outer container 602 are coupled together, the collar assembly 636 assists in maintaining the coupling between the inner sleeve 606 and the outer container 602 and prevents decoupling. In the illustrated embodiment, this coupling is maintained by interference fit; however, it should be appreciated that threaded attachment and other coupling attachments besides interference fit are also within the scope of the present disclosure.

The annular rim 638 hangs over the wall 624 of the inner sleeve 606, creating a space beneath the annular rim 638. In the illustrated embodiment, collar assembly 636 includes a seal and a collar that are configured to nest with one another inside at least a portion of the space and extend from the space adjacent the annular rim 638. In that regard, the seal may be made from a flexible material capable of compression, such as silicon or rubber. The collar may be more rigid, for example, manufactured as an injected molded plastic part. The jogged shape of the collar, as described in greater detail below, allows for ease of assembly with the seal. The seal includes an annular body having a first end and a second end. At the first end, the seal includes first and second interface areas and for receiving and mating with first and second locking portions of the collar. Moreover, the first end of the seal is configured to be received within the space beneath the annular rim 638. At the second end, the seal includes a seal ridge configured to be received within the outer container and to form a seal therewith. It should be appreciated, however, that the outer container 602 and the inner sleeve 606 may be mated together without a locking mechanism, for example, using a plug seal fit (for example, similar to a wine cork fit), a magnetic attachment, a latch, or any other suitable mating mechanism.

As mentioned above, the collar includes first and second locking portions. These locking portions are coupled to connecting portions to form a collar structure. To maintain positioning relative to the inner sleeve 606, the collar includes a plurality of inner extensions that are configured to engage with the plurality of depressions in the outer wall 624 of the inner sleeve 606. (Of note, the plurality of depressions are formed by punching the plurality of extensions 640 into the wall 624 of the inner sleeve 606.) The locking portions each include a respective tab 642 that is configured to mate with each of the notches 620 in the first open end 614 of the outer container 602.

At the second open end 628 of the inner sleeve 606, the inner sleeve 606 is configured to couple with the filtration assembly 608. In the illustrated embodiment, the second open end 628 of the inner sleeve 606 includes threads 644 for a screw fit interface with opposite threads 646 on the outer perimeter of the filtration assembly 608. Although shown as a screw fit interface between the second open end 628 of the inner sleeve and the filtration assembly 608, it should be appreciated that other interfaces, such as an interference fit interface, are also within the scope of the present disclosure.

Figure 7:
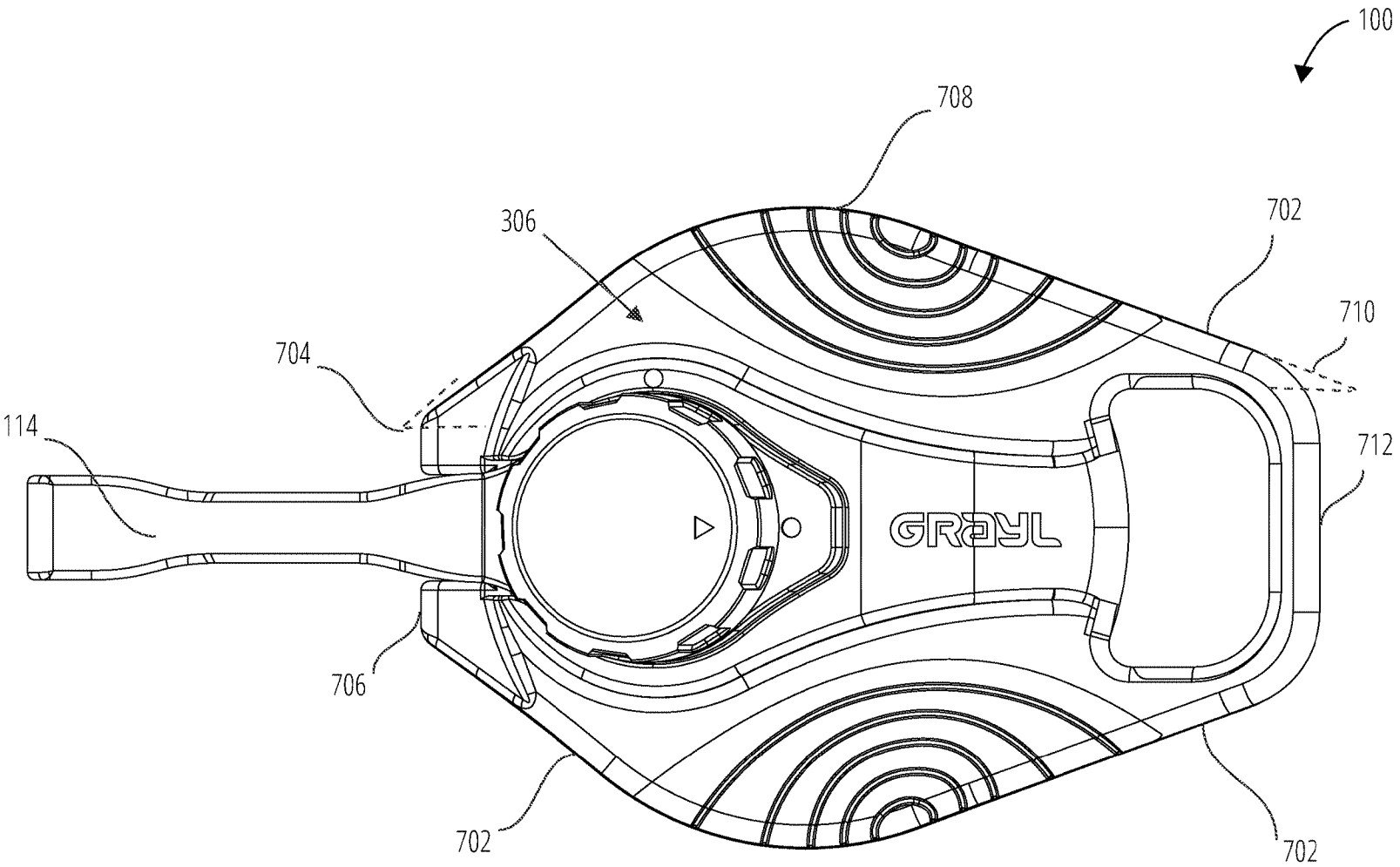
FIG. 7 illustrates an embodiment of a top view of a filtration container lid 100.

Referring to FIG. 7, the filtration container lid 100 comprises a first concave surface 306, which further comprises a perimeter 702, a first angle 704, an anterior end 706, a first midpoint 708, a second angle 710, and a first posterior end 712.

The first concave surface 306 is described in FIG. 3. The first concave surface 306 defines a perimeter 702 that is shaped by the anterior end 706, the first midpoint 708, and the first posterior end 712. The anterior end 706 tapers at the first angle 704 to the first midpoint 708, and the first posterior end 712 tapers at the second angle 710 to the first midpoint 708. This may occur for both the first side and the second side of the first concave surface 306. The transition regions at the first angle 704, the first midpoint 708, and the second angle 710 along the perimeter 702 may be a continuous taper.

The first angle 704 may be defined by a line normal to the anterior end 706 and a line extending from the anterior end 706 to the first midpoint 708. The anterior end 706 is the portion of the perimeter 702 of the first concave surface 306 located nearest to the leash 114. The first midpoint 708 is the portion of the perimeter 702 that transitions from the first angle 704 to the second angle 710. The transition may be tapered. The second angle 710 may be defined by a line normal to the first posterior end 712 and a line extending from the first posterior end 712 to the first midpoint 708. The first posterior end 712 is the portion of the perimeter 702 of the first concave surface 306 located furthest from the leash 114. In some embodiments, the distance along the perimeter 702 from the first posterior end 712 to the first midpoint 708 (i.e., the first distance) is 1 to 3 times the distance along the perimeter 702 from the anterior end 706 to the first midpoint 708 (i.e., the second distance).

Figure 8:
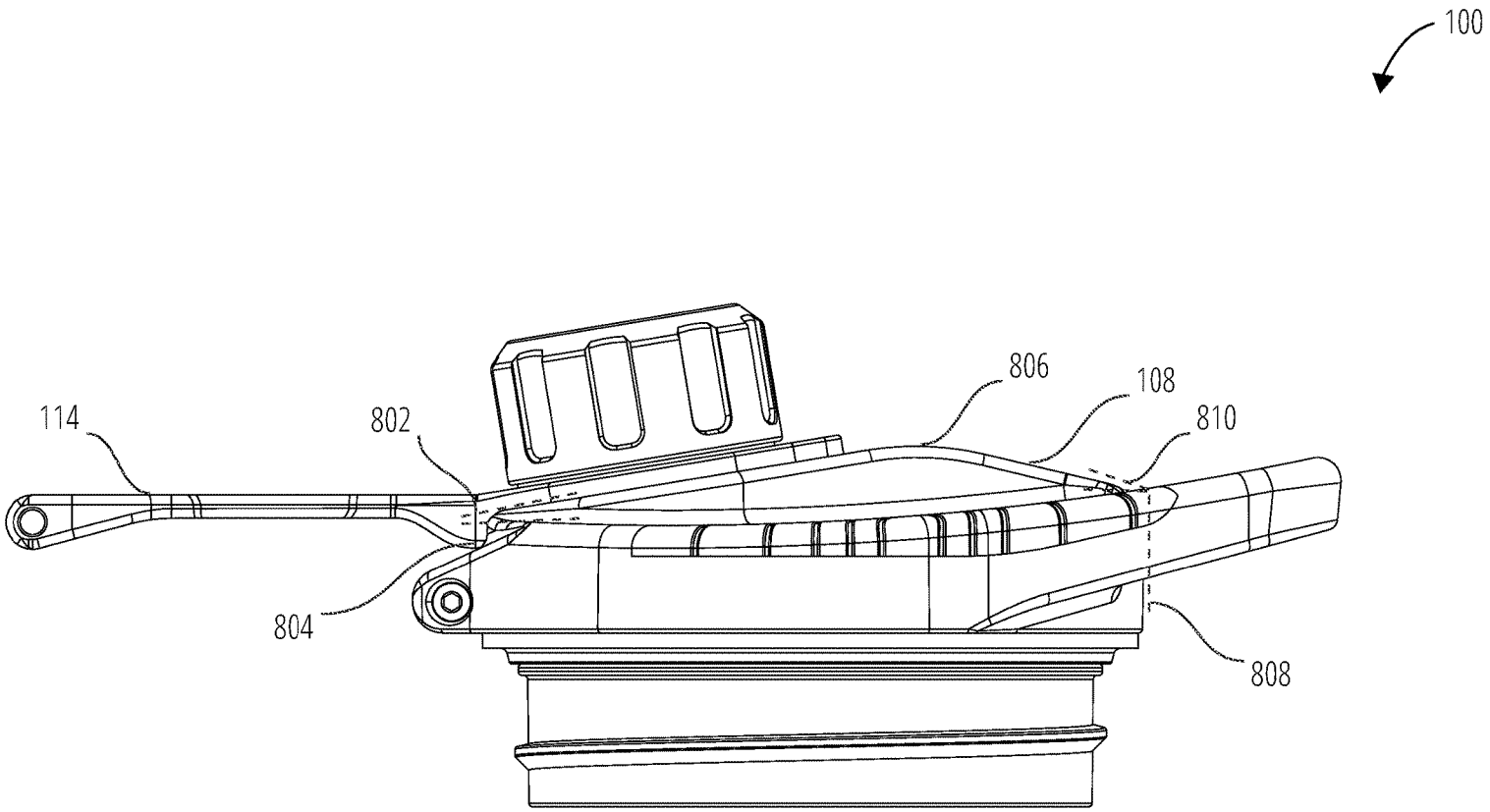
FIG. 8 illustrates an embodiment of a side view of a filtration container lid 100.

Referring to FIG. 8, the filtration container lid 100 comprises a cap-mounting portion 108, which comprises a third angle 802, an anterior end 804, a second midpoint 806, a second posterior end 808, and a fourth angle 810.

The cap-mounting portion 108 is described in FIG. 1. A surface of the cap-mounting portion 108 is defined by the anterior end 804, the second midpoint 806, and the second posterior end 808. The anterior end 804 tapers at the third angle 802 to the second midpoint 806 and the second posterior end 808 tapers to the second midpoint 806 at the fourth angle 810. The transition regions at the third angle 802, the fourth angle 810, and the second midpoint 806 along the cap-mounting portion 108 may be a continuous taper.

The third angle 802 may be defined by a line normal to the anterior end 804 and a line extending from the anterior end 804 to the second midpoint 806. The anterior end 804 is the portion of the cap-mounting portion 108 located nearest to the leash 114. The second midpoint 806 is the portion of the cap-mounting portion 108 that transitions from the third angle 802 to the fourth angle 810. The transition may be tapered. The fourth angle 810 may be defined by a line normal to the second posterior end 808 and a line extending from the second posterior end 808 to the second midpoint 806. The second posterior end 808 is the portion of the cap-mounting portion 108 located furthest from the leash 114. In some embodiments, the distance from the anterior end 804 to the second midpoint 806 (i.e., the third distance) is 1 to 3 times the distance from the second posterior end 808 to the second midpoint 806 (i.e., the fourth distance). The transition from the second posterior end 808 to the cap-mounting portion 108 may be rounded to inhibit the abrasive effect of a non-rounded edge on skin. The rounding of the second posterior end 808 to cap-mounting portion 108 transition may result in the fourth angle being defined by a line extending to the second midpoint 806 from a point in the now voided space (due to the rounded edge) instead of the second posterior end 808 itself.

"midpoint" in this context refers to a point somewhere in the middle, which may or may not be the exact middle point.

"distance" in this context refers to length of the shortest path between two points while remaining on some surface.

"cap" in this context refers to a protective lid or cover for an object, such as a bottle.

"concave surface" in this context refers to a surface that is curved in or hollowed inward, as opposed to convex.

"leash" in this context refers to a strap or cord that may be utilized for restraining.

"wall" in this context refers to a three-dimensional structure having one or more surfaces.

"fluid" in this context refers to a substance that has no fixed shape and yields easily to external pressure; e.g., a gas or (especially) a liquid.

What is claimed is:

1. A filtration container lid comprising:
   - a top wall, the top wall comprising a first concave surface and a bottom surface;
   - a cap-mounting portion, the cap-mounting portion:
     - joined to the top wall at the first concave surface;
     - dividing the first concave surface of the top wall into a first side and a second side;
     - comprising two or more second concave surfaces, one of the second concave surfaces joined to the first side of the top wall and another one of the second concave surfaces joined to the second side of the top wall; and
     - coupled to a cap;
   - a side wall, the side wall joined to and oriented normal to the bottom surface of the top wall;
   - a filtration container assembly attachment, the filtration container assembly attachment joined to the side wall; and
   - the cap is rotatably coupled to the cap-mounting portion, the cap-mounting portion comprising an annular threaded component, the cap having multiple mechanical states to secure to the annular threaded component, the multiple mechanical states including a sealed mechanical state and a venting mechanical state.

2. The filtration container lid of claim 1, wherein the first concave surface and the second concave surfaces form a receiving surface, the receiving surface configured to receive an object providing a force opposite the receiving surface.

3. The filtration container lid of claim 2, wherein the object is a human thumb.

4. The filtration container lid of claim 1, wherein the filtration container lid being configured to be detachably coupled to a filtration container assembly by way of the filtration container assembly attachment.

5. The filtration container lid of claim 1, wherein the cap is located adjacent to an anterior portion of the top wall, the first concave surface oriented parallel to the bottom surface at the anterior portion and at one or more first angles at a posterior portion, the posterior portion located opposite to the anterior portion.

6. The filtration container lid of claim 1 further comprising a leash, the leash being coupled to the cap and the side wall, the leash securing the cap to the filtration container lid when the cap is not secured to the cap-mounting portion.

7. The filtration container lid of claim 1, wherein the side wall is annular-shaped and comprising an outer surface and an inner surface, the filtration container assembly attachment joined to the inner surface of the side wall.

8. The filtration container lid of claim 1, wherein the top wall comprises a frictional portion on each of the first side and the second side.

9. The filtration container lid of claim 1, wherein the cap-mounting portion further comprises a spout extending from the cap-mounting portion, the spout having a first diameter, the spout further comprising a spout channel, the spout channel having a second diameter less than the first diameter.

10. The filtration container lid of claim 9, wherein the spout channel tapers between the first diameter and the second diameter.

11. The filtration container lid of claim 9, wherein the spout comprises an edge, the edge positioned opposite from the cap-mounting portion on the spout, the spout channel positioned adjacent to the edge on the spout.

12. A filtration container lid comprising:

a top wall, the top wall comprising:

a first concave surface, the first concave surface having a perimeter, the perimeter tapering on a first side and a second side at a first angle from an anterior end to a first midpoint on the first side and another first midpoint on the second side, and tapering on the first side and the second side at a second angle from a first posterior end to the respective first midpoint where each respective first midpoint is positioned along the perimeter between the anterior end and the posterior;

a bottom surface;

a first frictional portion on the first side; and a second frictional portion on the second side;

a cap-mounting portion, the cap-mounting portion:

joined to the top wall at the first concave surface;

dividing the first concave surface of the top wall into the first side and the second side;

tapering away from the top wall at a third angle from the anterior end to a second midpoint and from a second posterior end to the second midpoint at a fourth angle;

comprising second concave surfaces, one of the second concave surfaces joined to the first side of the top wall and another one of the second concave surfaces joined to the second side of the top wall, the second concave surfaces flowing into the first concave surface to form a concave transition surface on the first side and the second side, the concave transition surface being a continuously concave surface; and coupled to a cap;

a side wall, the side wall joined to and oriented normal to the bottom surface of the top wall; and a filtration container assembly attachment, the filtration container assembly attachment joined to the side wall.

13. The filtration container lid of claim 12, wherein a first distance, the first distance being along the perimeter from the first posterior end to the first midpoint, is 1 to 3 times a second distance, the second distance being along the perimeter from the anterior end to the first midpoint.

14. The filtration container lid of claim 12, wherein a third distance, the third distance being from the anterior end to the second midpoint, is 1 to 3 times a fourth distance, the fourth distance being from the second posterior end to the second midpoint.

15. The filtration container lid of claim 12, wherein the first frictional portion and the second frictional portion comprise 25 to 75 percent of the first concave surface of the top wall.

16. The filtration container lid of claim 12, wherein the cap-mounting portion further comprises a spout extending from the cap-mounting portion, the spout having a first diameter, the spout further comprising a spout channel, the spout channel having a second diameter less than the first diameter.

17. The filtration container lid of claim 16, wherein the spout channel tapers between the first diameter and the second diameter.

18. The filtration container lid of claim 16, wherein the spout comprises an edge, the edge positioned opposite from the cap-mounting portion on the spout, the spout channel located closer to the edge than the cap-mounting portion.

* * * * *